US006705334B2

(12) United States Patent
Altobelli

(10) Patent No.: US 6,705,334 B2
(45) Date of Patent: Mar. 16, 2004

(54) SCRIPTURED OUTDOOR FURNITURE

(76) Inventor: Marie A Altobelli, 202 Beech St., Kearny, NJ (US) 07032

( * ) Notice: Subject to any disclaimer, the term of this patent is extended or adjusted under 35 U.S.C. 154(b) by 0 days.

(21) Appl. No.: 09/933,793

(22) Filed: Aug. 21, 2001

(65) Prior Publication Data

US 2003/0037811 A1 Feb. 27, 2003

(51) Int. Cl.[7] ..... A47B 37/04; G09F 19/00

(52) U.S. Cl. ..... 135/16; 108/50.12; 40/317; 40/320; 297/219.1; 297/440.11; D06/611

(58) Field of Search ..... 135/16, 33.41, 135/33.2; 108/50.12, 147.18; 248/188.8, 188.9, 534, 514, 228.6, 231.71; 40/317, 320, 617, 603; 297/219.1, 440.11, DIG. 6, 218.1; D06/374, 611

(56) References Cited

U.S. PATENT DOCUMENTS 192,770 A * 7/1877 Lacomme
218,382 A * 8/1879 Gruyer
278,973 A * 6/1883 Kizer
635,811 A * 10/1899 Rothschild
923,596 A * 6/1909 Staples
1,304,753 A * 5/1919 Dwyer
2,221,366 A * 11/1940 Bisbing et al.
2,409,622 A * 10/1946 Gottfried
2,559,421 A * 7/1951 Garrett
2,988,310 A * 6/1961 Wright
3,176,699 A * 4/1965 Rollins
3,233,618 A * 2/1966 Ferrier
3,248,147 A * 4/1966 Testa
3,338,252 A * 8/1967 Strom
3,417,764 A * 12/1968 Hemenway
3,477,453 A * 11/1969 D'Ulisse et al.
3,765,434 A * 10/1973 Riggs
3,977,721 A * 8/1976 Peterson
4,078,756 A * 3/1978 Cross
4,449,542 A * 5/1984 McSwain et al.
4,537,443 A * 8/1985 Gray
4,541,666 A * 9/1985 Vanderminden
4,542,757 A 9/1985 Phillips
4,601,120 A 7/1986 Levin
4,784,436 A * 11/1988 Sutherland
4,794,939 A 1/1989 Okuda
4,832,163 A 5/1989 Levesque
4,871,141 A * 10/1989 Chen
4,892,353 A * 1/1990 Goddard (List continued on next page.)

FOREIGN PATENT DOCUMENTS

GB 327748 4/1930
GB 2222942 * 3/1990 ..... A45B/3/02

*Primary Examiner*—Robert Canfield
(74) *Attorney, Agent, or Firm*—Michael I. Kroll

(57) ABSTRACT

The present invention 10 discloses scriptured outdoor furniture comprising an umbrella 12, swivel clamp 26, foldable table 22 and foldable chair 18. The umbrella 12 is of a size forming a canopy over the table 22 and chair 18. The umbrella 12 has a fastening member 26 fixed to the distal end of the central post 24 spaced away from the canopy whereby the umbrella can be releasably attached to the table 22. The fastener 26 is comprised of a swivel clamp 28 having a stationary jaw and a movable jaw 24 having a threaded shaft 30 having a handle 32 for advancing/retracting the movable jaw toward the stationary jaw. The umbrella 12 has an attachable detachable skirt 50 having mating fasteners 52, 54 positioned on the skirt and interior edge of the umbrella. The chair 18 has an attachable detachable chair backing 56. The chair backing 56 has mating fasteners 58 that are engaged after wrapping around the chair structural members 60. Furthermore, the table 22 has foldable extension elements 40 forming additional support for the overhanging canopy.

7 Claims, 12 Drawing Sheets

U.S. PATENT DOCUMENTS 4,923,247 A * 5/1990 Malmstrom
5,121,938 A * 6/1992 Gross et al.
5,172,712 A * 12/1992 Robinson
5,227,215 A 7/1993 Sklar
5,255,954 A 10/1993 Rogers
5,269,157 A * 12/1993 Ciminelli et al.
5,350,215 A * 9/1994 DeMars
5,417,166 A 5/1995 Credle, Sr.
5,431,364 A * 7/1995 Etter
5,438,779 A 8/1995 Suarez
5,441,789 A * 8/1995 Walker
5,449,012 A 9/1995 Friedman
5,478,041 A 12/1995 Mayne
D370,336 S * 6/1996 Rosier
5,700,053 A * 12/1997 Downing
5,829,832 A * 11/1998 Molce et al.
5,836,327 A 11/1998 Davis
5,873,624 A * 2/1999 Simpson
D413,429 S * 9/1999 Carson
5,957,528 A * 9/1999 Campbell
6,006,462 A * 12/1999 Lackomar
6,119,989 A * 9/2000 Hollington et al.
6,189,968 B1 * 2/2001 Emanuel et al.
D447,902 S * 9/2001 Black
6,371,555 B1 * 4/2002 Edwards et al.
6,401,736 B1 * 6/2002 Jerry
6,405,742 B1 * 6/2002 Driscoll
2002/0074839 A1 * 6/2002 Mahan
2002/0116846 A1 * 8/2002 Wu

* cited by examiner

SCRIPTURED OUTDOOR FURNITURE

BACKGROUND OF THE INVENTION

1. Field of the Invention

The present invention relates generally to outdoor furniture and more specifically to scriptured outdoor furniture. The scriptured outdoor furniture is comprised of an umbrella, swivel clamp, foldable table and foldable chair. The umbrella is of a size forming a canopy over the table and chair. The purpose of said umbrella is to serve as a sun block for an individual seated in said chair and for the surface of said table. The umbrella has a fastening member fixed to the distal end of the central shaft spaced away from the canopy whereby the umbrella can be releasably attached to the table. The fastener is comprised of a swivel clamp having a stationary jaw and a movable jaw. Said movable jaw is comprised of a threaded shaft having a handle for advancing/retracting said movable jaw toward said stationary jaw. The umbrella-engaging element is comprised of a tube having an aperture for inserting the handle of the umbrella. The tube terminates in a swivel hinge whereby the umbrella can be extended from a stored table parallel position to a table perpendicular position during use. The umbrella does not have to be removed from the clamping mechanism. The table and umbrella form an easy to carry, set up and store unit.

The umbrella has a scenic design portrayed on the external surface with a biblical scriptural passage imprinted thereon. The foldable chair also has a scenic design and biblical scriptural passage imprinted on the exterior of the chair back support.

The scenic design and scriptural passage enhances human communication between persons of like mind. It further unobtrusively encourages communication of religious beliefs using the visual arts and conveys a common ground whereby other scriptural practitioners are provided a comfortable atmosphere encouraging communication and affords individuals a medium to display their faith.

In additional elements the umbrella and chair have exchangeable elements having biblical scriptural passage imprinted thereon whereby the umbrella and chair can be arrayed with sentiment targeting religious holidays or other special events.

The umbrella has an attachable detachable skirt having mating fasteners positioned on the skirt and interior edge of the umbrella. The chair has an attachable detachable chair backing. The chair backing has mating fasteners that are engaged after wrapping around the chair structural members.

Furthermore, the table has foldable extension elements forming additional support for the over hanging canopy.

2. Description of the Prior Art

There are other furniture designs for outdoor furniture. Typical of these is U.S. Pat. No. 4,542,757 issued to Phillips on Sep. 24, 1985. Another patent was issued to Levin on Jul. 22, 1986 as U.S. Pat. No. 4,601,120. Yet another U.S. Pat. No. 4,794,939 was issued to Okuda on Jan. 3, 1989 and still yet another was issued on May 23, 1989 to Levesque as U.S. Pat. No. 4,832,163.

Another patent was issued to Sklar on Jul. 13, 1993 as U.S. Pat. No. 5,227,215. Yet another U.S. Pat. No. 5,255,954 was issued to Rogers on Oct. 26, 1993 and still yet another was issued on May 23, 1995 to Credle, Sr. as U.S. Pat. No. 5,417,166.

Another patent was issued to Suarez on Aug. 8, 1995 as U.S. Pat. No. 5,438,779. Yet another U.S. Pat. No. 5,449,012 was issued to Friedman on Sep. 12, 1995 and still yet another was issued on Dec. 26, 1995 to Mayne as U.S. Pat. No. 5,478,041 and still yet another was issued on Nov. 17, 1998 to Davis as U.S. Pat. No. 5,836,327.

Another was issued to Steel on Apr. 11, 1930 as United Kingdom patent No. 327,749

U.S. Pat. No. 4,542,757

Inventor: Bradford E. Phillips

Issued: Sep. 24, 1995

An umbrella having a flexible cover that is usable in either a rib supported cover open position or a rib collapsed cover folded position. An advertising flag is attached to the umbrella cover, the advertising flag extending upwardly beyond the exterior surface of the cover when the umbrella is in the open position so as to display the advertising message thereon. Preferably the advertising flag is sized and positioned so that the flag is at least partially concealed between the folds of the umbrella cover when the cover is folded about the centerpost in the storage position.

U.S. Pat. No. 4,601,120

Inventor: William J. Levin

Issued: Jul. 22, 1986

An illuminated sign is formed on a flexible substrate and installable onto a garment or an umbrella having a deployable frame with a web member extending thereover. The illuminated sign is provided with a plurality of lamps, which may be light-emitting diodes, arranged to correspond with the shape of the symbols on the illuminated sign. The electrically interconnected lamps are electrically connectable to a battery via a switch which controls conduction of electrical energy to the lamps. Additionally, a flasher circuit may be provided for causing the lamps to flash on and off periodically. When installed on an umbrella, the switch may be located at a distance from the illuminated sign, such as on the handle thereof.

U.S. Pat. No. 4,794,939

Inventor: Toshio Okuda

Issued: Jan. 3, 1989

An umbrella in which at least a portion of the cover's peripheral edge is shirred. This shirred edge portion is stretched to a greater length when the umbrella is open and contracted to a lesser length when the umbrella is collapsed, thereby providing a taut appearance to the cover when the umbrella is open in the dome-shaped configuration. This invention is particularly useful when the cover is fabricated from a single piece of material, i.e., when the cover is not comprised of separate gores stitched together.

U.S. Pat. No. 4,832,163

Inventor: Kathleen L. Levesque

Issued: May 23, 1989

A portable table preferably composed of a pair of containers which cooperate in face to face relationship to form a composite table surface and further servers as a support to the pole portion of a beach umbrella U.S. Pat. No. 5,227,215

Inventor: Rissa Sklar

Issued: Jul. 13, 1993

A religious article that first functions as a canopy or chuppah for a wedding ceremony and then when cut into pieces serves as individual prayer shawls ortallitot for the couple. The religious article has two rows of heavy stitching, each adjacent to a longitudinal or latitudinal axis and perpendicular to the weftor warp of the material. The religious article also contains four reinforced corners and four additional reinforced areas each having holes provided therein. When the religious article is cut along the axis, forming two prayer shawls, each shawl has reinforced corners with holes through which are attached braided religious fringes or tzitziyot.

U.S. Pat. No. 5,255,954

Inventor: Bill L. Rogers

Issued: Oct. 26, 1993

A chair back connected umbrella support is formed by an open frame, vertically supporting an elongated sleeve slidably receiving the shank of an umbrella. The frame is removably supported by an inclined chair back by J-shaped hooks connected therewith and the umbrella shank receiving sleeve is disposed substantially vertically by a pair of tubes projecting laterally of the frame and nested by sockets connected with the chair back below the J-shaped hooks. A cam lever engaging the umbrella shank vertically adjustably supports the umbrella relative to the chair and the occupant therein.

U.S. Pat. No. 5,417,166

Inventor: Michael T. Credel, Sr.

Issued: May 23, 1995

A portable umbrella table is easily assembled and is affixed to the ground by a central hollow stake. The umbrella includes a shaft which is joined to a post which slides through the hollow stake into the ground to provide additional security and stability to table during wind gusts. Adjustable straps are provided on the bottom surface of the table top to laterally contain the umbrella against the table top for transportation and storage and a table top handle allows one person to easily transport the umbrella table before and after use.

U.S. Pat. No. 5,438,779

Inventor: Mercedes Suarez

Issued: Aug. 8, 1995

Advertising display comprising a body forming a display screen which is fixed on the laminar cover of a sunshade, umbrella or the like. Upon closing, the frame of the cover is capable of folding along with the corresponding portion of the display screen, while upon being unfolded, the display screen is positioned vertically.

U.S. Pat. No. 5,449,012

Inventor: Larry D. Friedman

Issued: Sep. 12, 1995

A hand-held umbrella with a mechanism for rotating the stem and dome of the umbrella relative to the handle without manual rotation of the handle or umbrella. The rotation is created by a battery-operated motor forming a portion of the handle and adapted to receive the end of the stem opposite of the dome. The exterior surface of the dome may have a picture message imprinted thereon which has the appearance of animated movement when the dome is rotated. A speaker and mechanism for producing audible sound are also incorporated into the handle. In one embodiment, the music is contained on a sound synthesizer chip.

U.S. Pat. No. 5,478,041

Inventor: Richard C. Mayne

Issued: Dec. 26, 1995

This invention relates to a clamping and holding device and more particularly to a clamping and holding device which can be attached to articles such as patio chairs to mount a holder for umbrellas and the like in a variety of positions. The device provides a first clamping arm and a second clamping arm pivotally connected to one another to engage an article. A holder extending laterally from the first clamping arm is provided to hold a tray, umbrella or the like. The holder may be locked in a variety of positions. A cam, cam follower and locking member or nut and bolt system prevents the inadvertent opening of the clamping arms U.S. Pat. No. 5,836,327

Inventor: Gary A. Davis

Issued: Nov. 17, 1998

An umbrella holder comprising a clamp mechanism; a right/left angular adjustment mechanism, a forward/rearward angular adjustment mechanism; a length adjustment mechanism; and an umbrella shaft and handle securing mechanism. The clamp mechanism includes an upper and lower jaw member, an upper and lower resilient clamp pad, and a clamp screw mechanism. Each upper and lower jaw member is provided with a clamp channel that is covered with the upper or lower resilient clamp pad, respectively. The clamp channels are oriented in opposed relationship and the clamp screw mechanism threadably engages the lower jaw member and rotatably engages the upper jaw member in a manner such that rotation of the clamp screw mechanism causes the upper and lower jaw to be forced together or apart depending on the direction of rotation of the clamp screw mechanism. The umbrella shaft and handle securing mechanism includes a shaft channel clamp and a handle strap assembly positioned below the shaft channel clamp. The shaft channel clamp includes a channel member having an elongated channel that is covered with resilient padding and sized to receive therein a portion of the shaft of an umbrella. A compression member rotatably connected to a shaft clamp screw mechanism is positioned within the elongated channel. The compression member has a resilient pad covering the compression surface thereof. The compression member is preferably elongated and can also have a curved channelized surface if desired. The handle strap assembly includes a flexible strap having an adjustable securing mechanism.

While these furniture devices may be suitable for the purposes for which they were designed, they would not be as suitable for the purposes of the present invention, as hereinafter described.

SUMMARY OF THE PRESENT INVENTION

The present invention discloses scriptured outdoor furniture comprising an umbrella, swivel clamp, foldable table and foldable chair. The umbrella is of a size forming a canopy over the table and chair. The umbrella has a fastening member fixed to the distal end of the central post away from the canopy whereby the umbrella can be releasably attached to the table. The fastener is comprised of a swivel clamp having a stationary jaw and a movable jaw having a threaded shaft having a handle for advancing/retracting the movable jaw toward the stationary jaw. The umbrella has an attachable detachable skirt having mating fasteners positioned on the skirt and interior edge of the umbrella. The chair has an attachable detachable chair backing. The chair backing has mating fasteners that are engaged after wrapping around the chair structural members. Furthermore, the table has foldable extension elements forming additional support for the overhanging canopy.

A primary object of the present invention is to provide outdoor scriptured furniture having an umbrella and chair with scriptural passage imprinted thereon.

Another object of the present invention is to provide outdoor scriptured furniture having a table for attachment thereon of the scriptural imprinted umbrella.

Yet another object of the present invention is to provide an expandable collapsible umbrella having illustrations of scenic displays imprinted upon the exterior surface of said umbrella.

Still yet another object of the present invention is to provide an expandable collapsible umbrella having illustrations of scenic displays and scriptural biblical passage imprinted upon the exterior surface of said umbrella.

Another object of the present invention is to provide a foldable chair having illustrations of scenic displays imprinted upon the seat back of said chair.

Yet another object of the present invention is to provide a foldable chair having illustrations of scenic displays and scriptural biblical passage imprinted upon the seat back of said chair.

Still yet another object of the present invention is to provide scriptured furniture having a swivel clamp forming an attachment member for said umbrella to said table.

Another object of the present invention is to provide scriptured furniture having a swivel clamp whereby the umbrella can be swiveled from a stored table parallel position to a table perpendicular position.

Yet another object of the present invention is to provide scriptured furniture having a table and scriptured umbrella whereby the umbrella can stay attached to said table for storing, moving, assembly and ease of use.

Additional objects of the present invention will appear as the description proceeds.

The present invention overcomes the shortcomings of the prior art by providing scriptured outdoor furniture. The scriptured outdoor furniture is comprised of an umbrella, swivel clamp, foldable table and foldable chair. The umbrella is of sufficient size forming a sun block for an individual seated in said chair and for the surface of said table and a scenic design is portrayed on the external surface with a biblical scriptural passage imprinted thereon. The foldable chair also has a scenic design and biblical scriptural passage imprinted on the exterior of the chair back support.

The scenic design and scriptural passage enhances human communication between persons of like mind. It further unobtrusively encourages communication of religious beliefs using the visual arts and conveys a common ground whereby other scriptural practitioners are provided a comfortable atmosphere encouraging communication and affords individuals a medium to display their faith.

The umbrella has a fastener member fixed to the distal end of the central shaft spaced away from the canopy whereby the umbrella can be releasably attached to the table. The fastener is comprised of a swivel clamp having a stationary jaw and a movable jaw. Said movable jaw is comprised of a threaded shaft having a handle for advancing/retracting said movable jaw toward said stationary jaw. The umbrella-engaging element is comprised of a tube having an aperture for inserting the handle of the umbrella. The tube terminates in a swivel hinge whereby the umbrella can be extended from a stored table parallel position to a table perpendicular position during use. The umbrella does not have to be removed from the clamping mechanism. The table and umbrella form an easy to carry, set up and store unit. In addition, the umbrella and chair have exchangeable elements with biblical scriptural passage imprinted thereon whereby the umbrella and chair can be arrayed with various scriptural passages.

The umbrella has an attachable detachable skirt having mating fasteners positioned on the skirt and interior edge of the umbrella. The chair has an attachable detachable chair backing. The chair backing has mating fasteners that are engaged after wrapping around the chair structural members.

Furthermore, the table has foldable extension elements forming additional support for the over hanging canopy.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
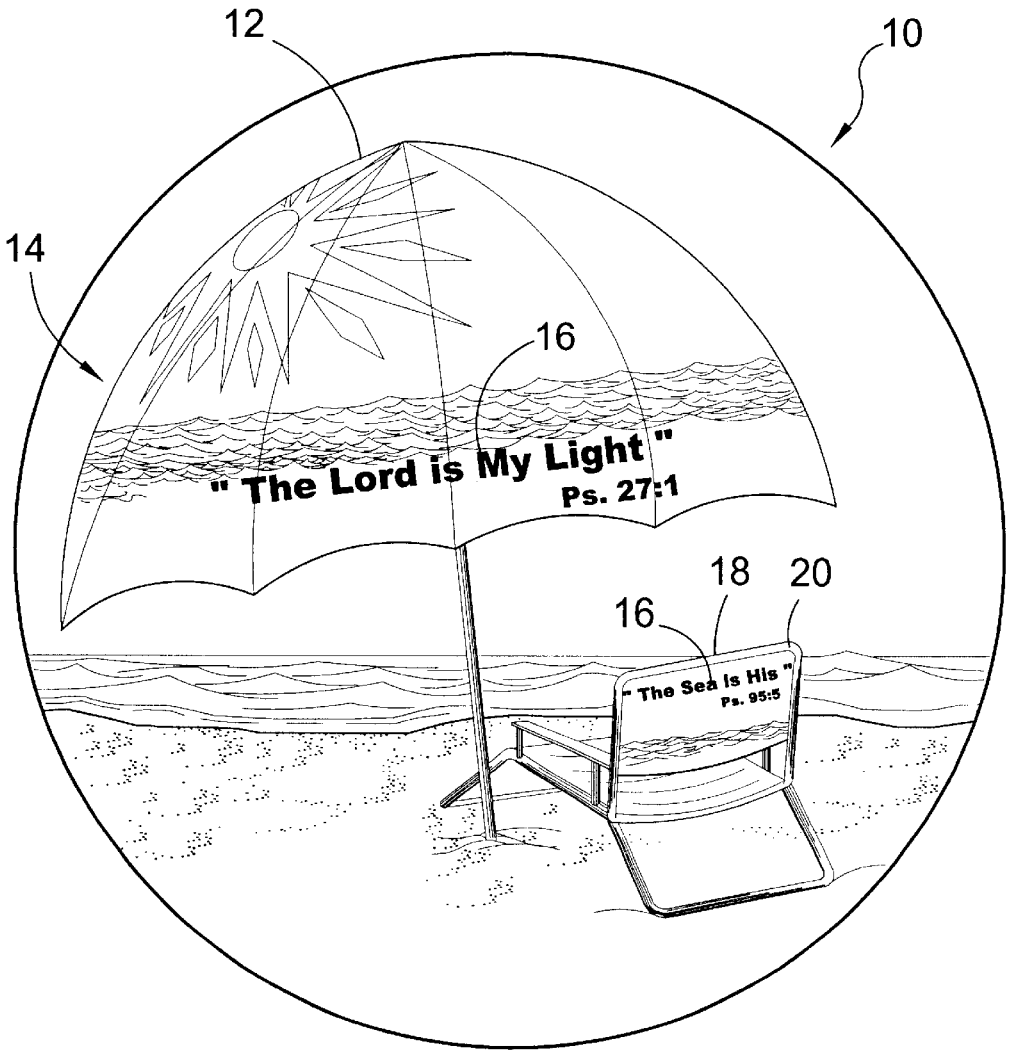
FIG. 1 is an illustrative view of the present invention in use.

With regard to reference numerals used, the following numbering is used throughout the drawings.

10 present invention
12 umbrella
14 scenic illustration
16 biblical scripture
18 chair
20 chair back
22 table
24 post
26 clamp mechanism
28 U-shaped clamp
30 threaded element
32 handle
34 jaw
36 swivel joint
38 locking pin
40 support flange
42 threaded member
44 leg of table
46 direction arrow
48 bushing
50 skirt
52 hook and loop material
54 snap
56 seat back material
58 mating hook and loop material
60 tubular side
62 flap

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning to FIG. 1, shown therein is an illustrative view of the present invention 10 in use. Shown is the present invention 10 being used as recreational outdoor furniture. The umbrella 12 has a scenic illustration 14 and biblical scripture 16 imprinted on the exterior surface. The chair 18 has another scenic illustration with biblical scripture 16 imprinted on the exterior surface of the chair back 20. The purpose of the biblical scripture 16 is to provide means for an individual to display their faith and to enhance human communication by providing a topical subject.

Figure 2:
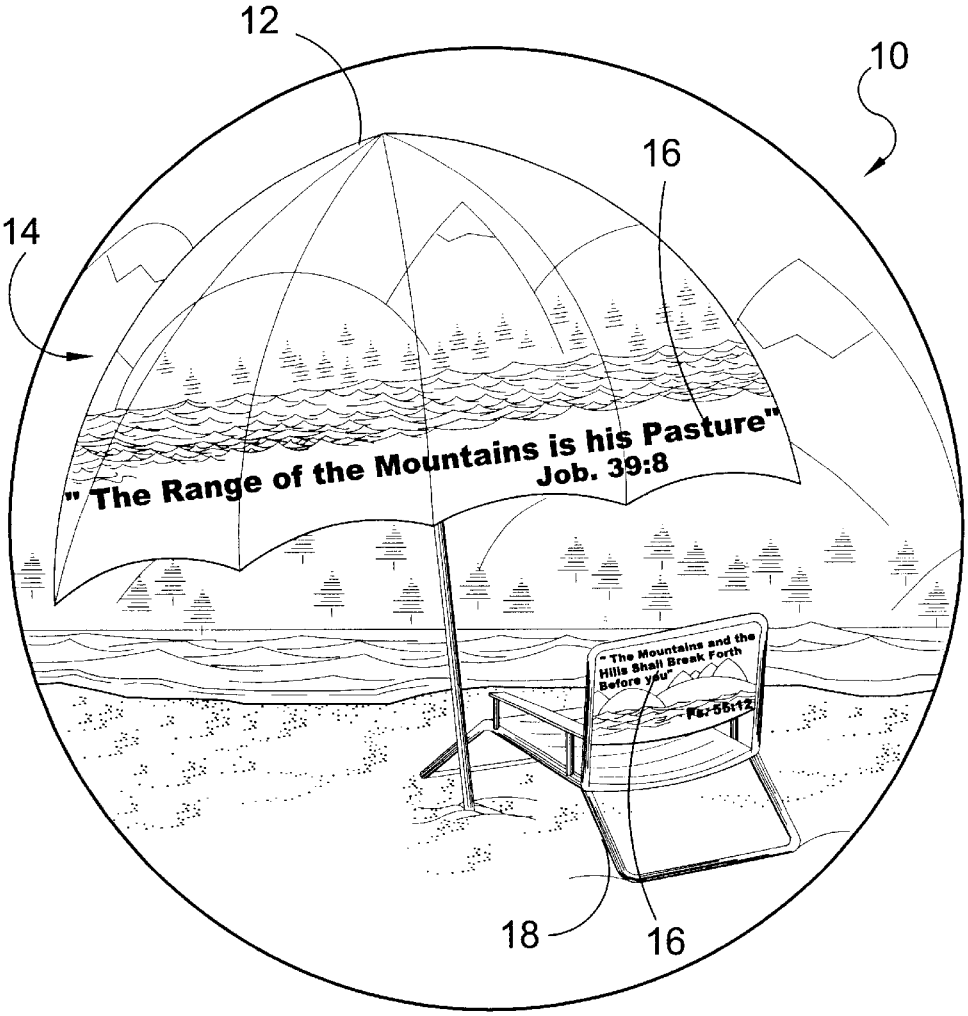
FIG. 2 is an illustrative view of the present invention in use.

Turning to FIG. 2, shown therein is an illustrative view of the present invention 10 in use showing another variation of the present invention in use. The umbrella 12 has a scenic illustration 14 and biblical scripture 16 imprinted on the exterior surface. The chair 18 has another scenic illustration 14 with biblical scripture 16 imprinted on the exterior surface of the chair back 20. The purpose of the biblical scripture is to provide means for an individual to display their faith and to enhance human communication by providing a topical subject.

Figure 3:
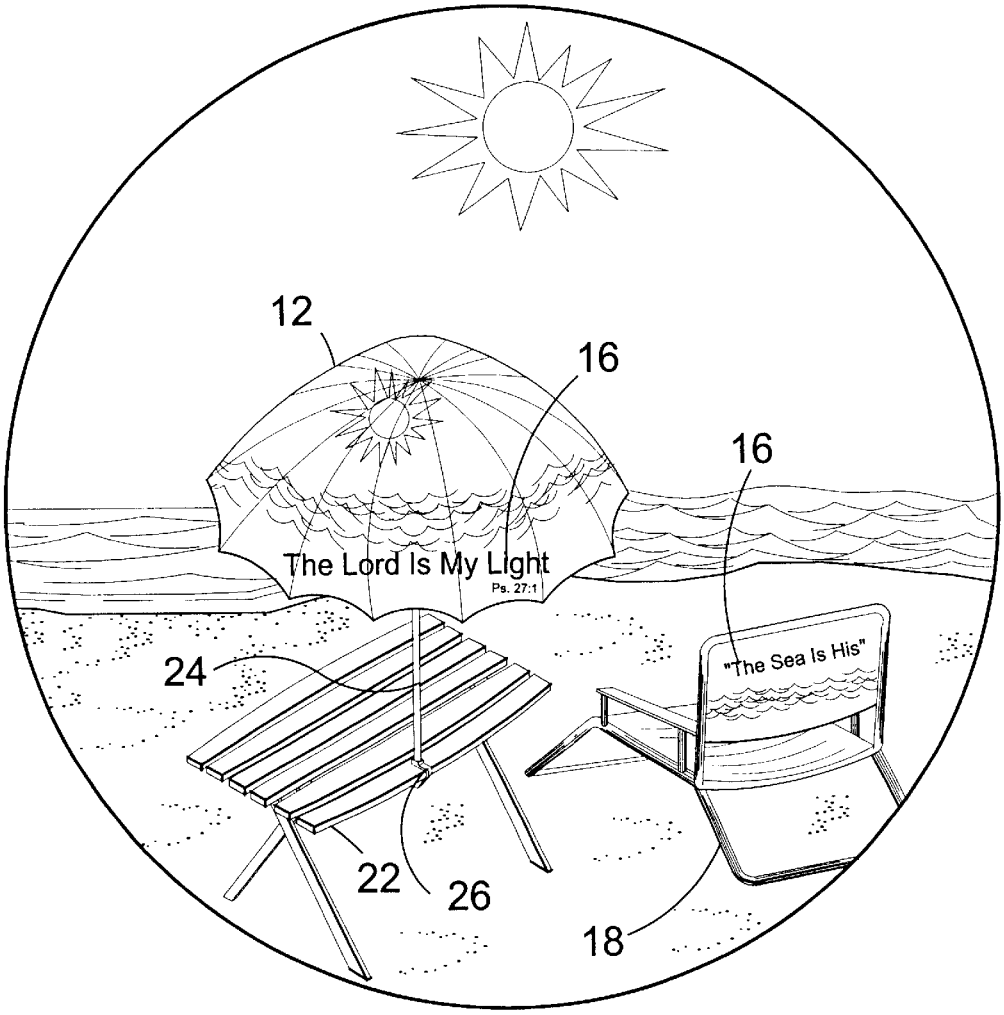
FIG. 3 is an illustrative view of an additional element of the present invention.

Turning to FIG. 3, shown therein is an illustrative view of an additional element of the present invention 10. Shown is the present invention with an additional element in the form of a table 22. The base distal end of the post 24 of the umbrella 12 has a clamping mechanism 26 affixed thereto whereby the umbrella 12 can be selectively attached to the top of the table 22. The table 22 provides a storage/workspace for such things as personal items, food storage and beach accessories. Also shown is the chair 18 and scripture verses 16.

Figure 4:
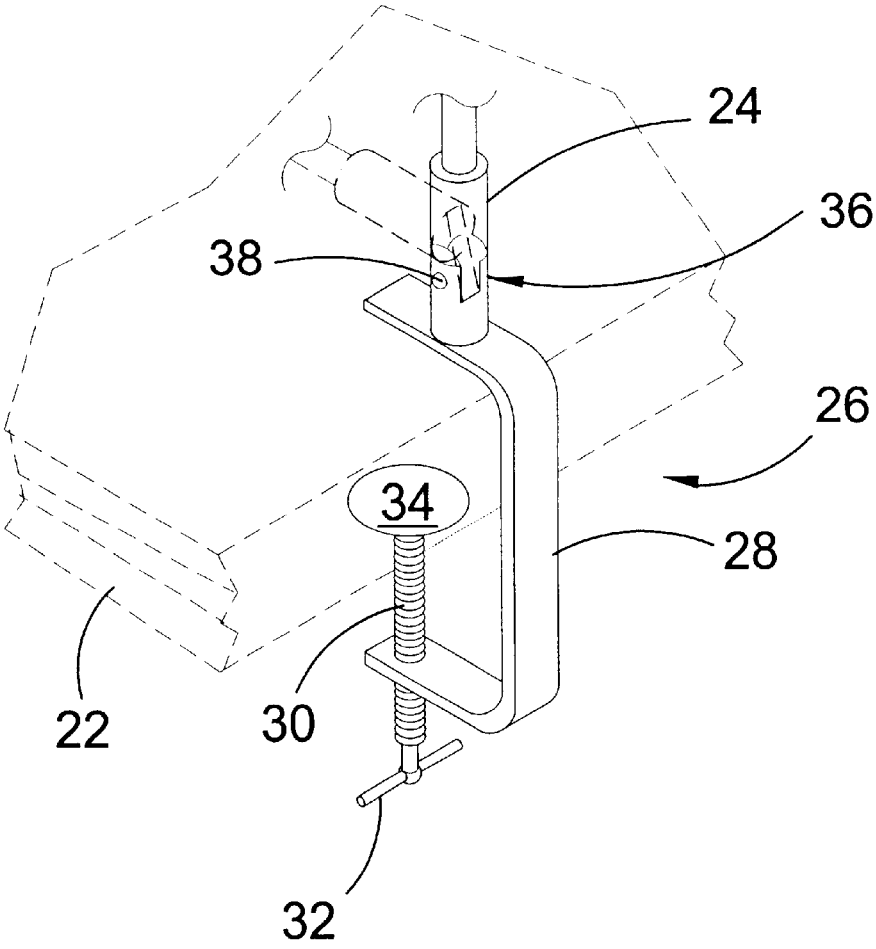
FIG. 4 is a side view of the clamping mechanism present invention.

Turning to FIG. 4, shown therein is a side view of the clamping mechanism 26 of the present invention. Depicted is one embodiment of the clamping mechanism 26 of the present invention wherein a clamp having a U-shaped clamp body 28 with an extendible retractable threaded element 30 with a handle 32 for engaging and disengaging the movable jaw 34 of the clamp forms attachment means for an umbrella. Also shown is a swivel joint 36 within the clamp whereby the umbrella may be swiveled to a substantially parallel position with the top of the table 22 for storage purposes. Therefore the umbrella and table form an easy to handle and store device. Also shown is the foldable umbrella post 24 along with an internal locking pin 38.

Figure 5:
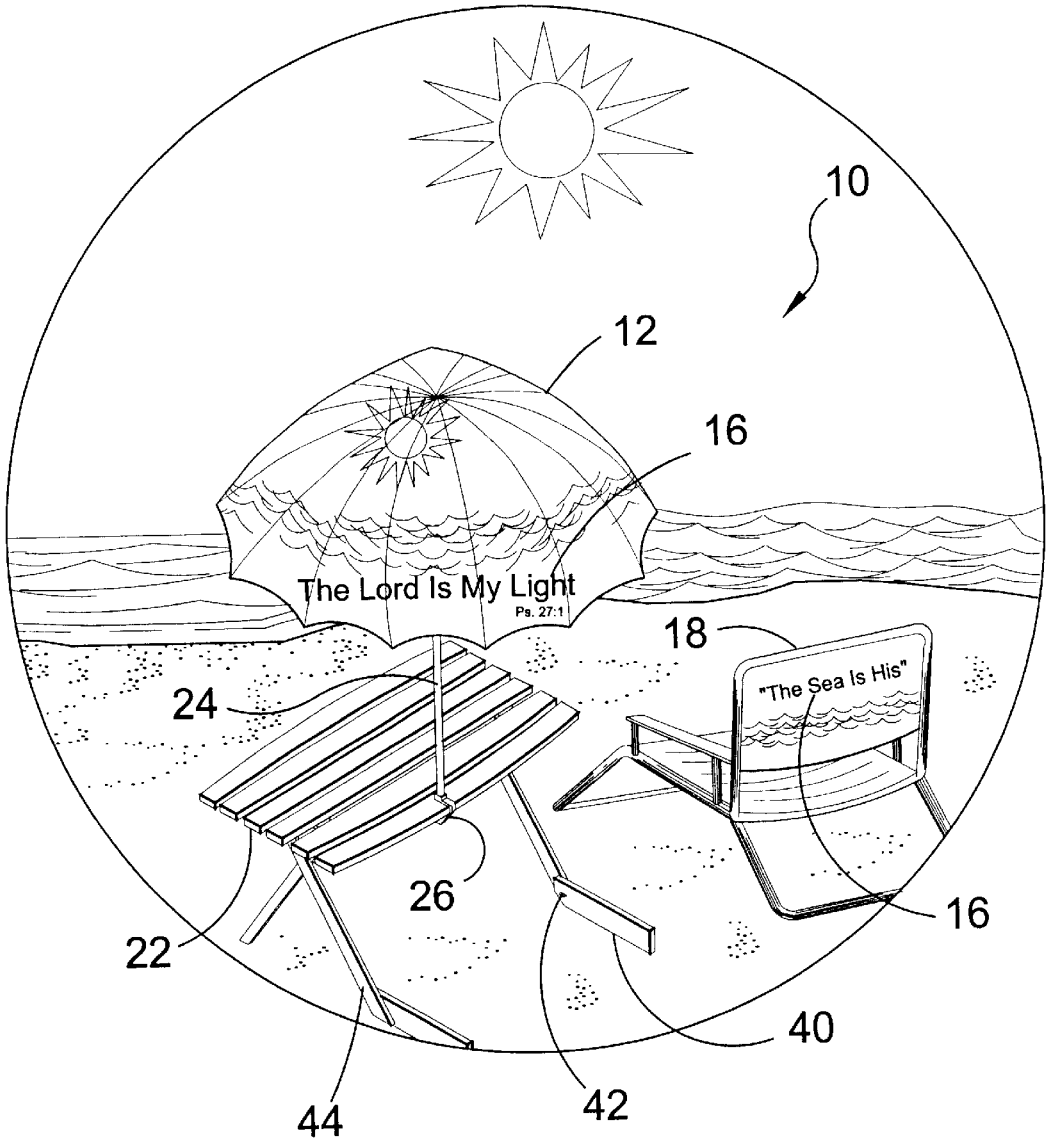
FIG. 5 is a perspective view of the present invention with table support members.

Turning to FIG. 5, shown therein is a perspective view of the present invention 10 with table support flange members 40. Shown is the present invention with the addition of table support members 40 that will prevent the table 22 from tipping over from a gust of wind because the center of gravity for the umbrella 12 is positioned on one edge of the table. The support members 40 are threadedly 42 attached to the base distal end of the table legs 44 having the umbrella central post 24 positioned thereover. The table support members can be selectively extended as needed. Other elements previously disclosed are also shown.

Figure 6:
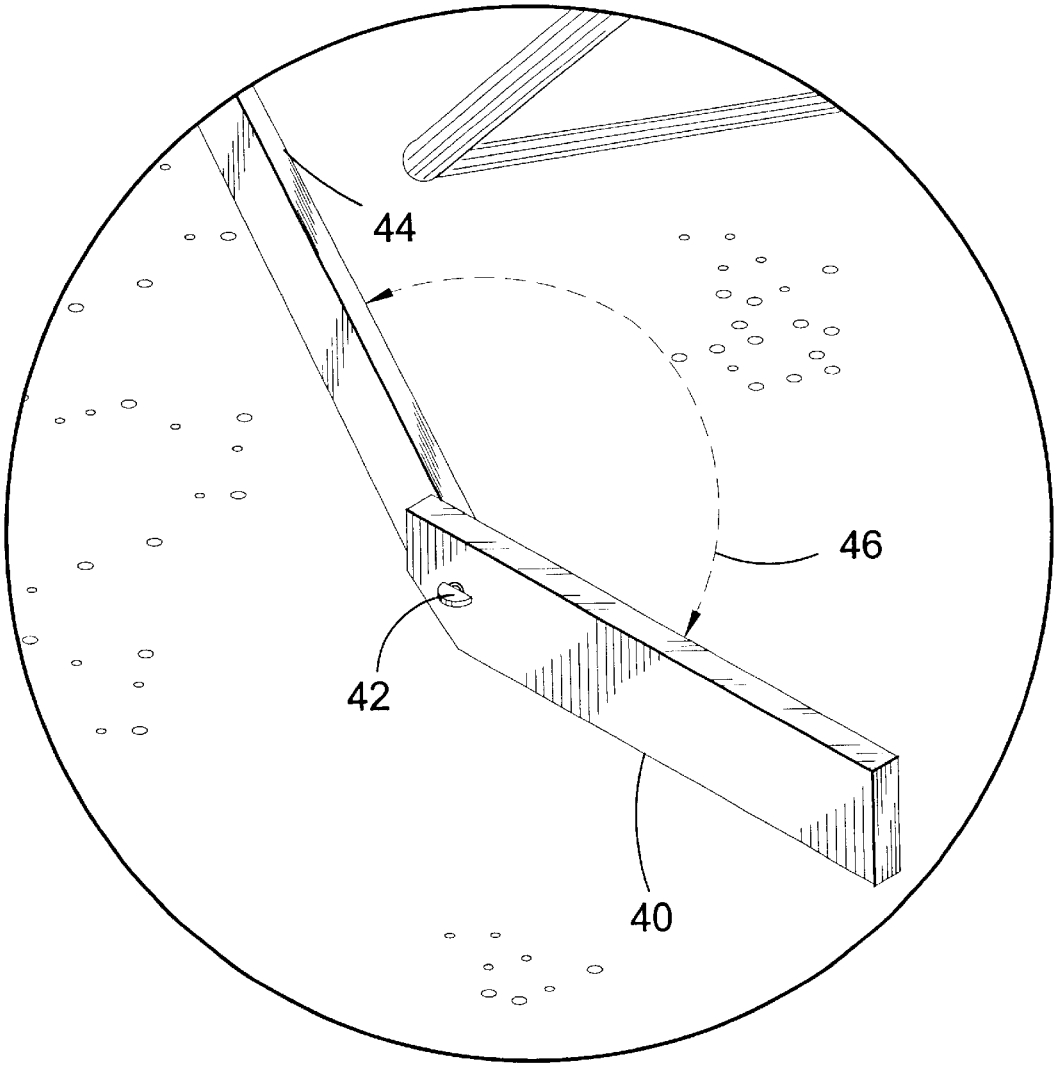
FIG. 6 is an enlarged perspective view of the support members of the present invention.

Turning to FIG. 6, shown therein is an enlarged perspective view of the support flange members 40 of the present invention 10. Shown is the table leg 44 of the present invention having extendable retractable support members 40 attached to the side of the table whereabove the umbrella will be clamped. The support members can be selectively extended for umbrella usage or rotated to a stowed position when the umbrella is not used. The support members have a threaded element 42 that compresses the support members between the threaded element 42 and the table legs 44. Releasing tension on the threaded element 42 permits selective rotation of the support member 40 as shown by direction arrow 46.

Figure 7:
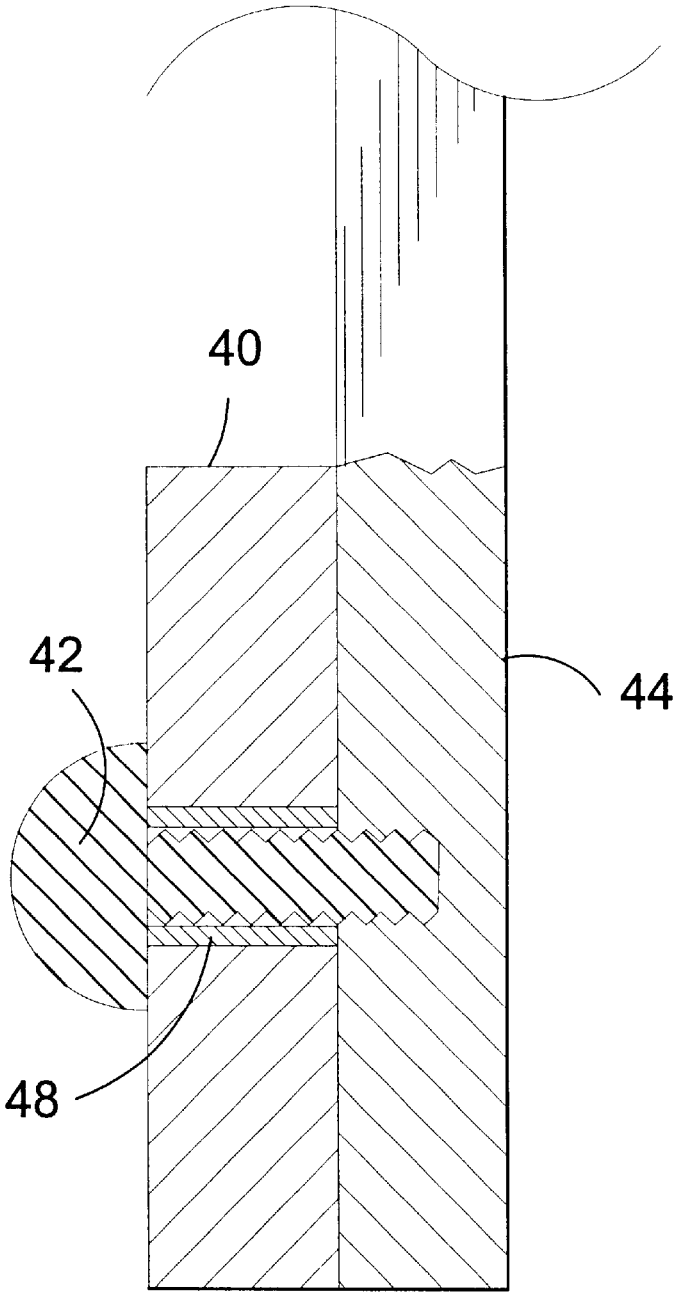
FIG. 7 is a cutaway view of the fastening member of the rotatable table support member.

Turning to FIG. 7, shown therein is a cut away view of the fastening member of the rotatable table support member 40. Shown is the threaded fastening member 42 of the table support member. The fastening member 42 is comprised of a head portion and a threaded portion. Within the table support member is a bushing 48 having a throughbore wherethrough passes the fastening member 42 which then threadedly engages the table leg 44. When the fastening member 42 is threaded into the table leg 44 the support member 40 is compressed between the fastener member head and the table leg 44 preventing further rotation of the support member 40. To rotate the table support member 40 between the stowed and extended position the fastener 42 is loosened and the support member rotated to the desired position before the fastener is tightened again.

Figure 8:
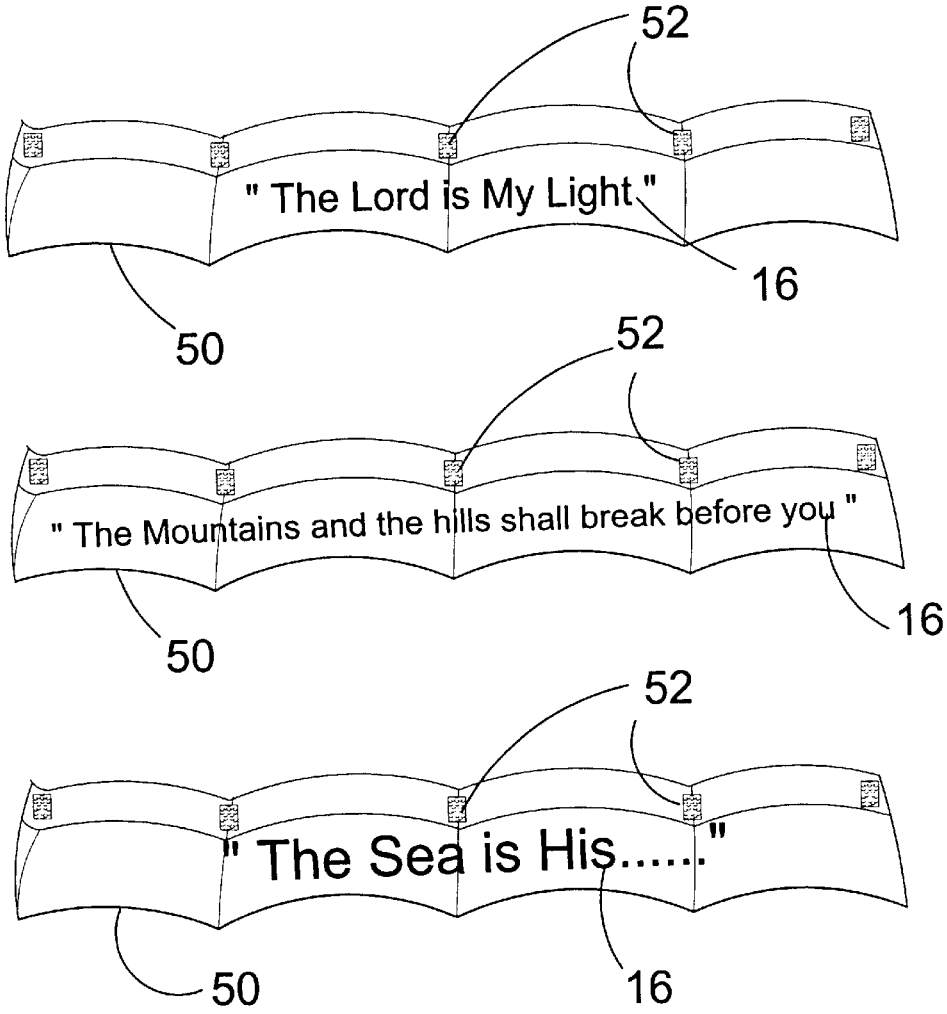
FIG. 8 is a front elevation of an additional element for the umbrella of the present invention.

Turning to FIG. 8, shown therein is a front elevation of an additional element for the umbrella of the present invention.

Illustrated is an attachable detachable skirt 50 that fastens to the interior hem of the umbrella extending circumferentially around the periphery of the umbrella whereby the scriptural message 16 can be changed to fit special religious occasions such as Easter. It could also be used to provide selective variation of the scriptural message. The fastening element preferably can be snap or Velcro 52 but can be in any appropriate form.

Figure 9:
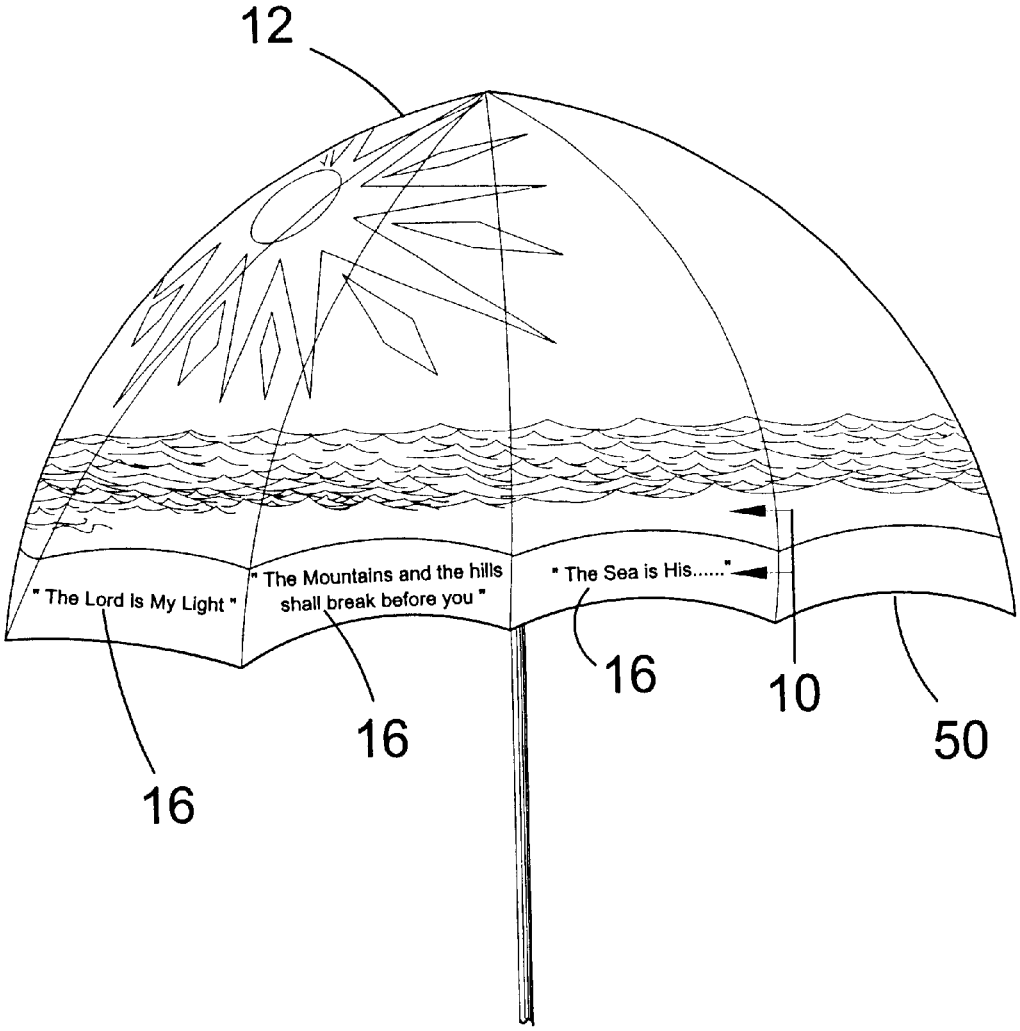
FIG. 9 is a front elevation of a skirt having a plurality of biblical scripture imprinted thereon.

Turning to FIG. 9, shown therein is a front elevation of a skirt 50 having a plurality of biblical scripture 16 imprinted thereon. Illustrated is the attachable detachable skirt 50 fastened to the interior hem of the umbrella 12 extending circumferentially around the periphery of the umbrella having a plurality of scriptural messages 16 imprinted thereon. The skirt 50 can be used to change the scriptural message for religious occasions such as Easter or selective variation. The skirt 50 is fastened to the interior of the umbrella by mating pieces of hook and loop material 52 attached to the interior of the umbrella 12 and on the skirt 50.

Figure 10:
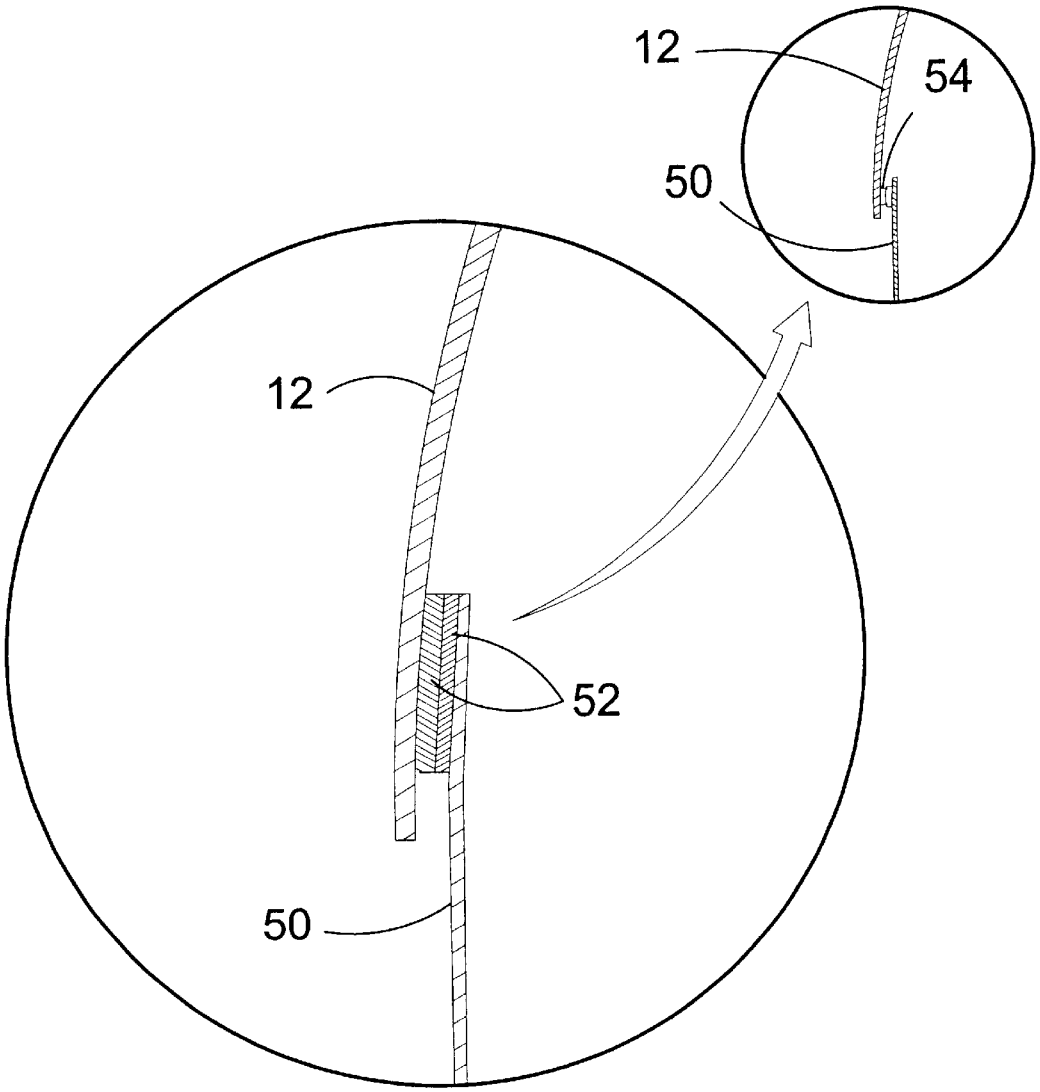
FIG. 10 is a sectional view of the umbrella and skirt with hook and loop fastener.

Turning to FIG. 10, shown therein is a sectional view of the umbrella 12 and skirt 50 with hook and loop fasteners 52. Shown is a fastener 52 of the umbrella and skirt in an engaged position. The interior periphery of the umbrella 12 has a plurality of one of the members of hook and loop material 52 while the skirt 50 has the plurality of mating hook and loop members 52. Alternatively, mating snap elements 54 are also shown.

Figure 11:
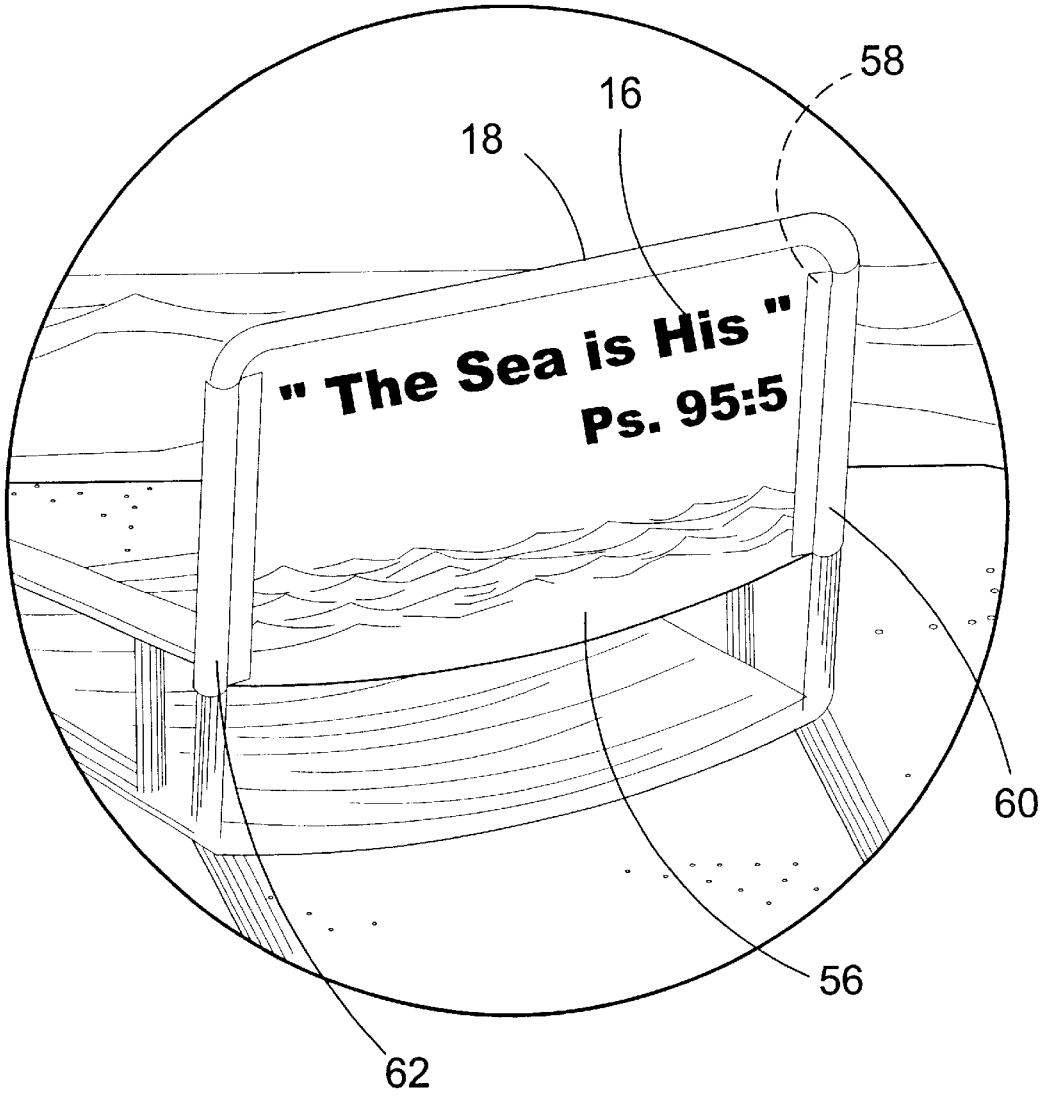
FIG. 11 is a front elevation of an additional element for the umbrella of the present invention.

Turning to FIG. 11, shown therein is a front elevation of an additional element for the umbrella of the present invention. Illustrated is an attachable detachable seating back 56 having mating lengths of hook and loop material 58 on each end of the seat backing with a securing flap 62 that wraps around the tubular sides 60 of the chair 18. The scriptural message can be changed to fit special religious occasions such as Easter. It could also be used to provide selective variation of the scriptural message.

Figure 12:
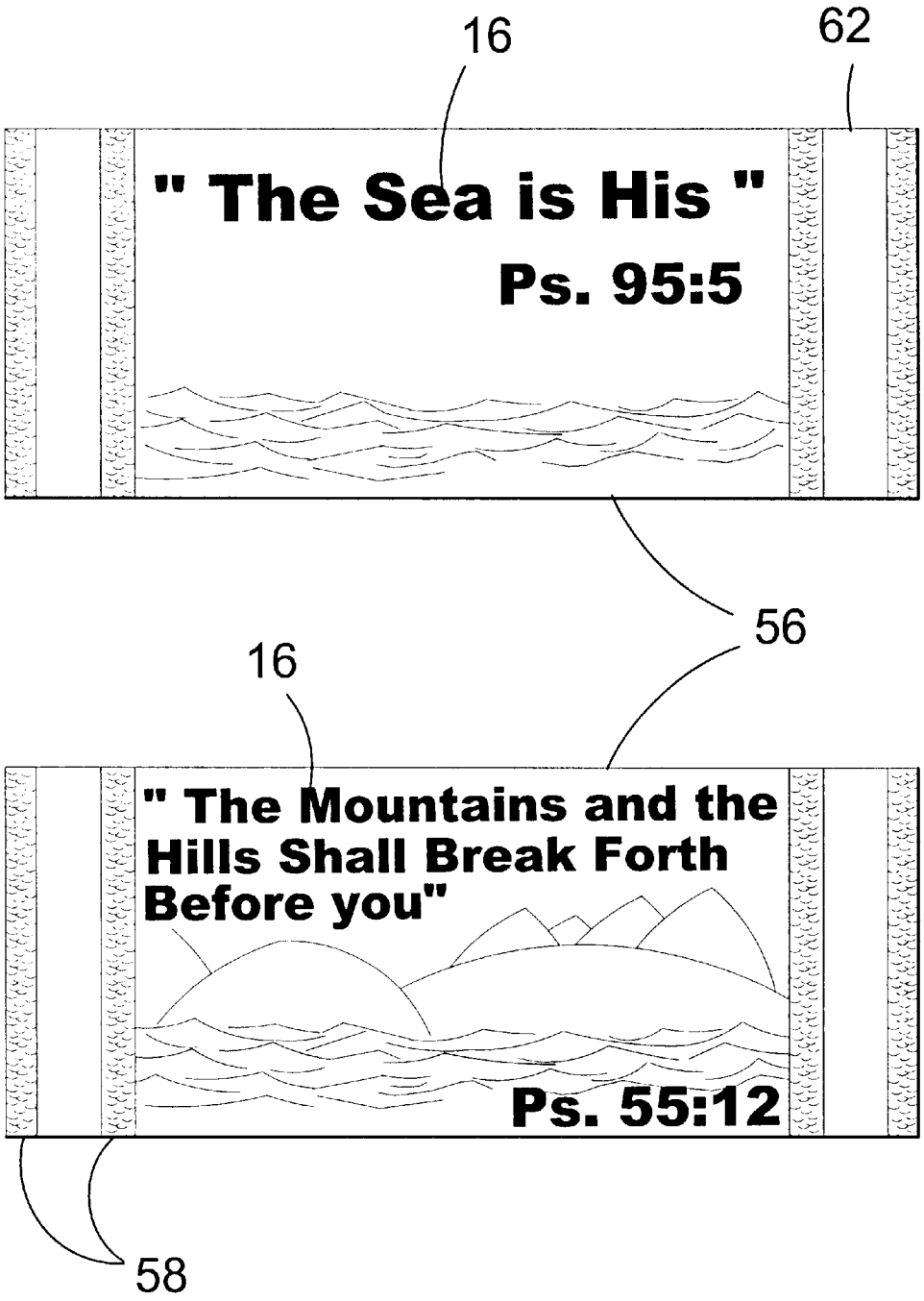
FIG. 12 is a front elevation of decorative attachable/detachable seating backs having a plurality of biblical scripture imprinted thereon.

Turning to FIG. 12, shown therein is a front elevation of decorative attachable detachable seating 56 having a plurality of biblical scripture 16 imprinted thereon. Illustrated is an attachable detachable seating backs 56 having mating lengths of hook and loop material 58 forming a securing flap 62 that wraps around the tubular sides of the chair back whereby the scriptural message can be changed to fit special religious occasions such as Easter. It could also be used to provide selective variation of the scriptural message.

What is claimed to be new and desired to be protected by Letters Patent is set forth in the appended claims:

1. An apparatus for an outdoor furniture group for displaying scriptures thereon, comprising:

a) an umbrella, said umbrella having a canopy and a post, said canopy disposed on said post, said post having a first end and a second end, said canopy disposed on said second end of said post;

b) a chair, said chair having a back thereon, said back having a pair of spaced apart vertical tubular support members on each side of said back;

c) a scripture display and scenic illustration disposed on said canopy of said umbrella;

d) a scripture display and scenic illustration disposed on said back of said chair;

e) a table, said table having a top and a plurality of legs thereon, said lens having a first end and a second end, said first end of said legs connected to said top;

f) means for clamping said umbrella onto said top of said table, said means for clamping being disposed on said first end of said post of said umbrella comprising a U-shaped clamp having a first jaw and second jaw for placement of said top of said table between wherein said first jaw is movable for attachment of the table top between said first jaw and said second jaw;

g) said movable jaw further comprises a threaded member for adjustment of said movable jaw and a handle disposed on said threaded member for turning said threaded member;

h) a foldable joint disposed at a juncture of said first end of said post and said U-shaped clamp whereby said post can be folded from a vertical position to a horizontal position, said foldable joint comprising a locking pin for securing said joint;

i) a support member disposed on said second end of said legs of said table whereby said table is supported; and j) said support member comprising an elongated member having a first end and a second end, and a threaded fastener for rotatably connecting said first end of said elongated member to said second end of said legs of said table for rotating said elongated member from a position co-planar and contiguous to said legs to a position lateral to said legs.

2. The apparatus of claim 1, wherein said first end of said elongated member has an aperture therein for receiving a bushing, wherein said bushing has a bore therein for receiving said threaded fastener so that said threaded fastener connects to said second end of said leg of said table.

3. The apparatus of claim 2, further comprising a skirt of material having a scripture display thereon removably disposed on the hem of said canopy of said umbrella.

4. The apparatus of claim 3, further comprising mating hook and loop material for connecting said skirt to an inner surface of said canopy of said umbrella wherein a first piece of hook and loop material disposed on an inner surface of said canopy of said umbrella mates to a second piece of hook and loop material disposed on said skirt.

5. The apparatus of claim 4, further comprising a piece of chair backing material having a scripture display thereon removably disposed on said back of said chair.

6. The apparatus of claim 5, further comprising mating hook and loop material for connecting said piece of chair backing material to said back of said chair.

7. The apparatus of claim 6, wherein each end of said piece of chair backing material has a first piece of hook and loop material thereon and each end further has a second piece of mating hook and loop material spaced apart therefrom a distance equal to the circumference of a tubular support member of the back of said chair for wrapping each end of said piece of chair backing material around a tubular support member of said chair.

* * * * *